United States Patent [19]

Hung

[11] Patent Number: 4,529,975

[45] Date of Patent: Jul. 16, 1985

[54] SEPARATE OVERLOAD DETECTING AND WARNING SYSTEM FOR HYDRAULIC JACK

[76] Inventor: Michael Hung, 6th Fl., 683, Ming-Sheng East Rd., Taipei, Taiwan

[21] Appl. No.: 454,854

[22] Filed: Dec. 30, 1982

Related U.S. Application Data

[63] Continuation-in-part of Ser. No. 319,382, Nov. 6, 1981, Pat. No. 4,417,236.

[51] Int. Cl.[3] ..... G08B 21/00

[52] U.S. Cl. ..... 340/626; 340/666

[58] Field of Search ..... 340/626, 665, 666; 254/93 R, 93 H; 177/45, 146; 92/5 R; 200/83 W

[56] References Cited

U.S. PATENT DOCUMENTS

| | | | |
|---|---|---|---|
| 1,828,022 | 10/1931 | Brand | 177/146 |
| 3,918,037 | 11/1975 | Hall | 340/626 |
| 4,039,084 | 8/1977 | Shinohara et al. | 177/146 X |

*Primary Examiner*—Jerry W. Myracle

*Attorney, Agent, or Firm*—McCormick, Paulding & Huber

[57] ABSTRACT

A separate overload detecting and warning system for hydraulic jacks comprises a load sensing bypass pipe channel communicating with the high-pressure piping of the hydraulic jack, a linear load sensing unit directly connected to the load sensing bypass pipe channel for receiving the pressure signal therefrom, a warning circuit system having a multiple load-limit setting arrangement electrically coupled with the linear load sensing unit, and a power source switch mechanically connected with the release valve of the hydraulic jack and electrically connected to the warning circuit system for automatically energizing and de-energizing the warning circuit system along with the closing and opening of the release valve. When the valve is turned to the closed position for starting a load-lifting operation, the warning circuit system will be energized to effect the circuit test to automatically indicate the circuit condition and to begin detecting the pressure state of the load-lifting operation with complete assurance of safe operation.

6 Claims, 4 Drawing Figures

SEPARATE OVERLOAD DETECTING AND WARNING SYSTEM FOR HYDRAULIC JACK

CROSS-REFERENCES TO RELATED APPLICATIONS

This application is a continuation-in-part of application Ser. No. 319,382 filed Nov. 6, 1981 by the inventor, now U.S. Pat. No. 4,417,236 issued Nov. 22, 1983.

BACKGROUND OF THE INVENTION

This invention relates to a safety device for hydraulic jacks, particularly to a separate overload detecting and warning circuit system disposed in the hydraulic jack for ensuring complete safety in operation.

As hydraulic jacks are widely used in lifting operations for ordinary mechanical work, the effort put toward safe construction of hydraulic jacks is tremendous and important to both life and property. Accordingly, the structure of the conventional high-grade hydraulic jacks at present usually takes the safety coefficient of the hydraulic cylinder wall into consideration by providing a safety valve in the high-pressure piping thereof so as to prevent the check valve of the high-pressure cylinder from being jammed (resulting from external overload thereof) in case of an abnormal high-pressure state occurring in the high-pressure cylinder. In this condition, the hydraulic fluid continuously pumped therefrom and compressed in the high-pressure piping will force the safety valve arranged with weak resistance thereto to pop open and let the hydraulic fluid return to the low-pressure cylinder so as to avoid the failure of the high-pressure cylinder as a result of unlimited rise of the pressure applied thereto. However, even with the safety limit marked on the conventional hydraulic jack for ensuring safe operation, the user usually takes a hydraulic jack with small capacity to perform the lifting operation requiring a greater capacity. The problem is that: (1) the user cannot exactly estimate the weight of the load; and (2) while the overload condition is developing on the hydraulic jack, no warning indication is given to the user. Moreover, as the aforesaid safety valve is usually provided at a place outside of the high-pressure cylinder, when the load on the hydraulic jack is suddenly increased (such as a worker casually climbing onto the load), a hazardous high pressure will be abruptly produced in the high pressure cylinder. In this case, not only the abnormal high pressure cannot be relieved, but also the worker operating the jack is not aware of this dangerous situation.

For overcoming the aforesaid defects of the conventional jacks, this inventor has designed an "Overload Detecting Device" and filed a patent application in Taiwan on Oct. 17, 1981, which application was granted as a Utility Model patent on July 22, 1982 with the Pat. No. 16450. The same application was also filed in the Patent and Trademark Office of the United States on Nov. 6, 1981 with the Ser. No. 319,382, which issued as U.S. Pat. No. 4,417,236. After reviewing the practical operation and making a further study of the above-mentioned invention, however, this inventor has again found that the technical disclosure of the previously designed "Overload Detecting Device" has a performance limit, i.e., it cannot provide the hydraulic jack with separate and multiple load-limit settings in overload sensing and warning operations.

SUMMARY OF THE INVENTION

Accordingly, the primary object of this invention is to provide a separate overload detecting and warning system for hydraulic jacks with a linear load sensing unit directly matched with a warning circuit system to effect separate and multiple load-limit setting and warning functions and expand the aforesaid performance limit while ensuring completely safe operation of the hydraulic jacks.

According to this invention, these and other objects are achieved by providing in a preferred embodiment a separate overload detecting and warning system for hydraulic jacks, which system comprises a load sensing bypass pipe channel communicatively linked with the high-pressure piping of the hydraulic jack, a linear load sensing unit directly connected to the load sensing bypass pipe channel for receiving a pressure signal therefrom, a warning circuit system having a multiple load-limit setting arrangement electrically coupled with the linear load sensing unit, and a power source switch arranged in connecting relationship with the release valve of the hydraulic jack and electrically connected to the warning circuit system for automatically turning on and off and energizing and de-energizing the warning circuit system along with the closing and opening of the release valve in effecting circuit testing, warning and overload sensing functions and completely ensuring safe operation.

These objects and other advantages of the invention will become clear from the following descriptions of a preferred embodiment when read in conjunction with the accompanying drawings.

DETAILED DESCRIPTION OF THE PREFERRED EMBODIMENT

Figure 1A:
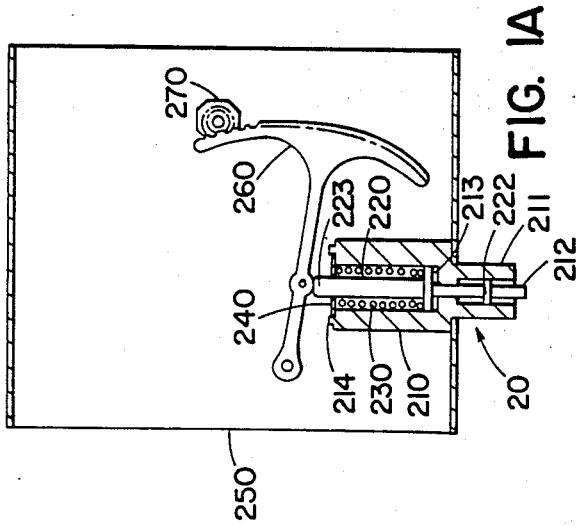
FIG. 1A is an enlarged sectional view of the linear load sensing unit shown in FIG. 1.
Figure 1:
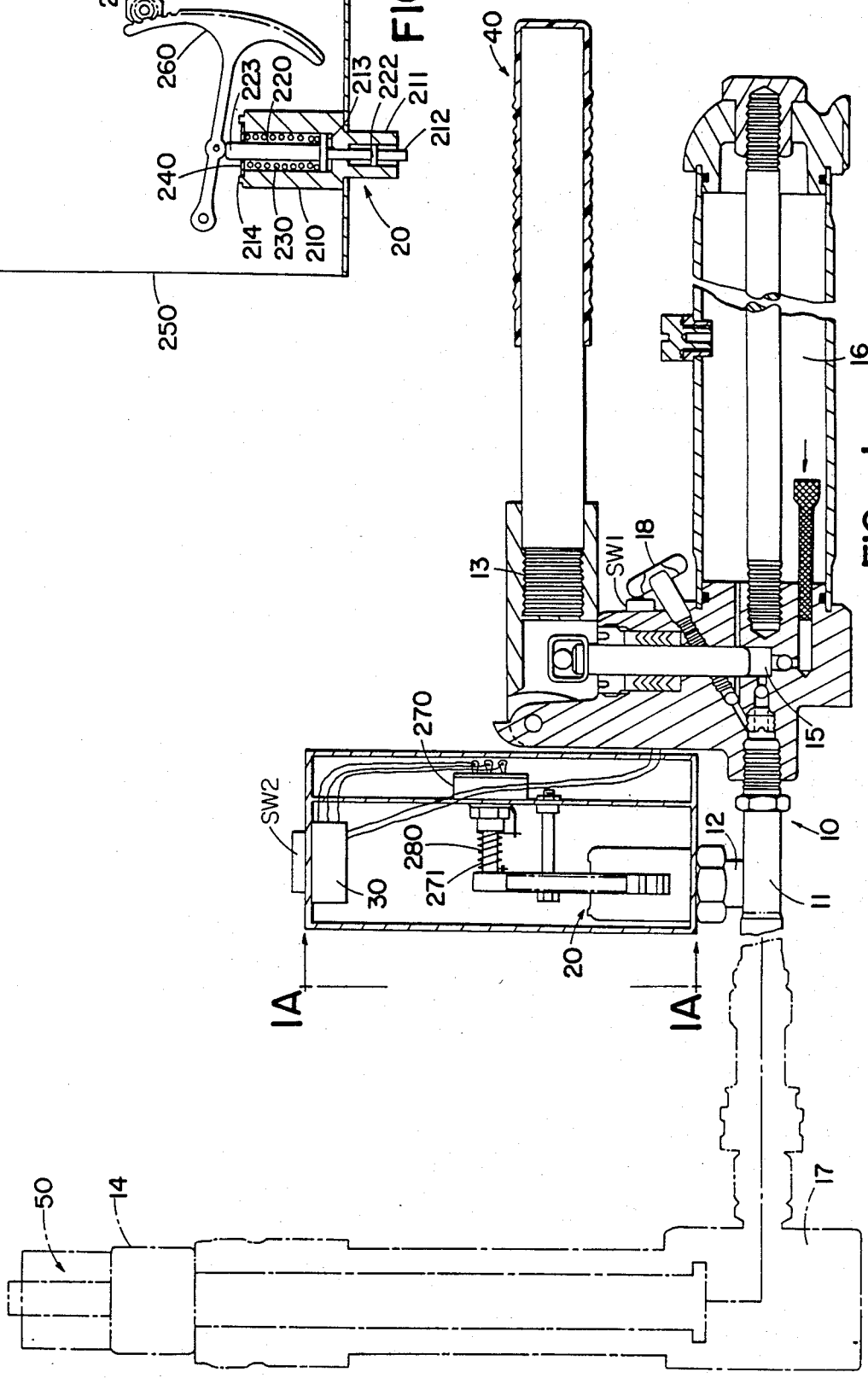
FIG. 1 is a structural illustration of a preferred embodiment of a separate overload detecting and warning system for hydraulic jacks according to this invention.

Referring to FIG. 1, a preferred embodiment of a separate overload detecting and warning system for hydraulic jacks comprises in combination: a load sensing bypass pipe channel 12 communicatively linked to the high-pressure piping 11 of the hydraulic jack 10; a linear load sensing unit 20 directly connected to the load sensing bypass pipe channel 12 for receiving the pressure signal therefrom; a warning circuit system 30 having multiple load-limit settings disposed therein electrically coupled with the linear load sensing unit 20; and a power switch $SW_1$ mechanically connected with the release valve 18 of the hydraulic jack 10 and electrically connected with the warning circuit system 30 for automatically controlling the turning "off" and "on" of the operating power of the warning circuit system 30 along with the closing and opening of the release valve 18.

As shown in FIG. 1A, the structure of the linear load sensing unit 20 comprises: a casing 210 housed within an outer supporting frame 250 with a connecting head 211 extending out of the supporting frame 250 at the front end of the casing 210; an oil passage 212 disposed in the connecting head 211 in communication with a valve chamber 213 formed therein; a dynamic oil seal 222 provided at a proper place in the oil passage 212; a crimped joint 214 fixed at the back end of the casing 210; a piston mechanism 220 having a crown rod 223 movably arranged in the casing 210; a pressure spring 230 disposed in coaxial relationship with the back portion of the piston mechanism 220; a covering plate 240 held by the crimped joint 214 at the back end of the piston mechanism 220 and through which the piston crown rod 223 extends; a sector rack 260 movably engaged with the top end of the crown rod 223 at a proper place of the rack stem and pivotally connected at one end to the supporting frame 250 for control by the crown rod 223 in up-and-down motion thereof; and a variable resistor 270 having a toothed revolving shaft 271 matched with a reversing spring 280 and secured on the supporting frame 250 with the toothed portion of the revolving shaft 271 in mesh with the teeth of the sector rack 260 for movement therewith.

Figure 2:
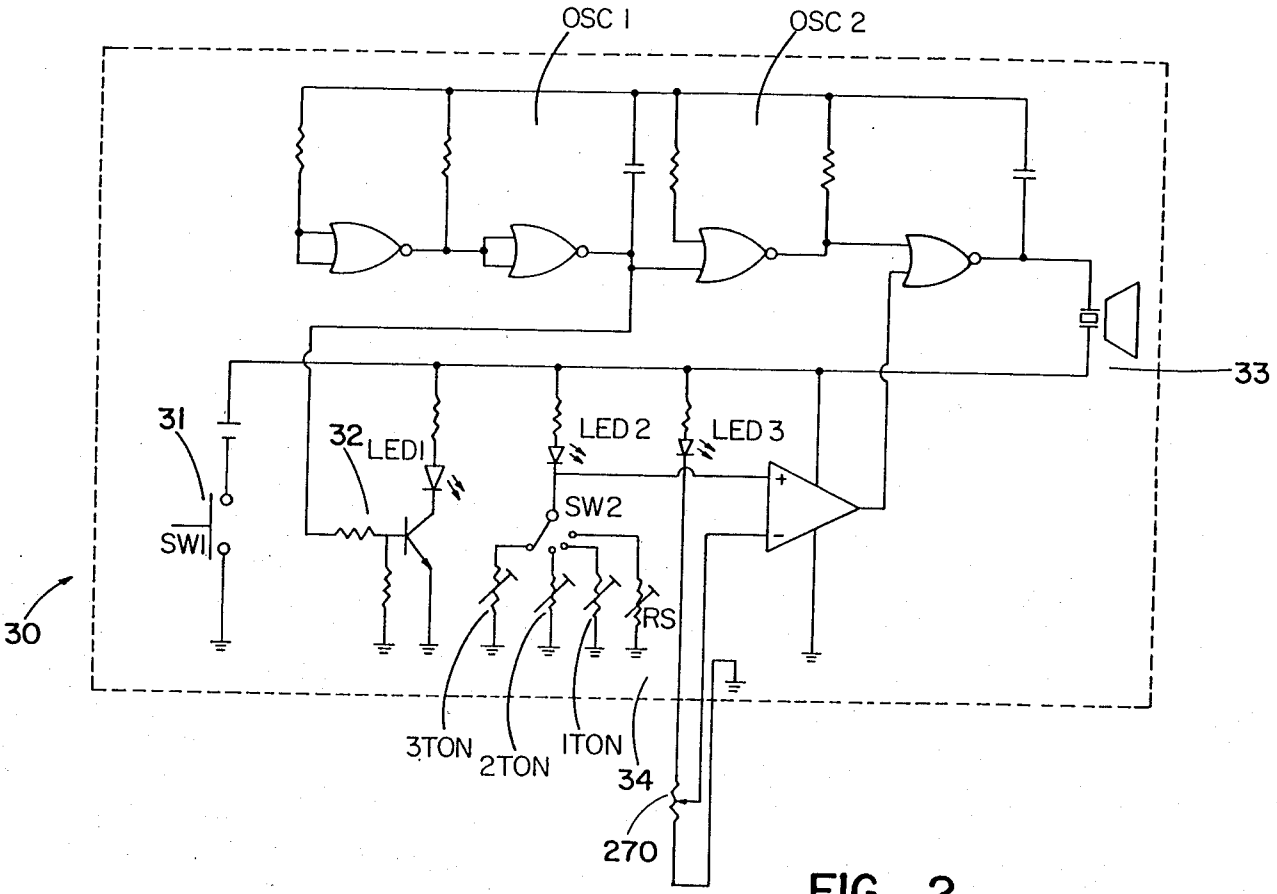
FIG. 2 is a circuit diagram of an overload sensing and warning circuit system shown in FIG. 1.

Shown in FIG. 2 is a schematic circuit diagram of the warning circuit system 30 having a DC power source 31 associated with the power switch $SW_1$. The switch $SW_1$ is mechanically connected with the release valve 18 (as shown in FIG. 1). An indicator circuit 32 with an $LED_1$ is connected to the DC power source 31, and a first multivibrator $OSC_1$ is electrically coupled with the indicator circuit 32. A second multivibrator $OSC_2$ is coupled with the first multivibrator $OSC_1$ for multiplying the output signal of $OSC_1$ and feeding it to an alarm device 33 electrically connected thereto for producing the warning sound thereat.

A limit setting and comparing circuit 34 is associated with the variable resistor 270, which is connected to the input terminal of the second multivibrator $OSC_2$ and provides a control signal for the alarming device 33. The limit setting and comparing circuit 34 includes a selective switch $SW_2$ functionally matched with multiple potential settings as shown in the figure for preselecting the limit potential thereof. An $LED_2$ is connected thereto for indicating the normal condition of the selective switch $SW_2$. An $LED_3$ is connected to the variable resistor 270 for indicating the normal state of the resistor 270, and a comparator is coupled therewith. In addition, the switch $SW_2$ is generally set at the potential setting RS for automatically detecting and comparing the potentials thereof. In normal conditions, when the detected potential is larger than or equal to the limit potential set thereat, control signals will be developed across the second multivibrator $OSC_2$ and the signals coming from the first multivibrator $OSC_1$, being multiplied by $OSC_2$, are fed to the alarming device 33 to produce warning sound. (The warning circuit system described above can also be installed either at the top of the rocker bar sleeve 13 of the hydraulic jack 10 or at other places within the protective outer casing).

Figure 3:
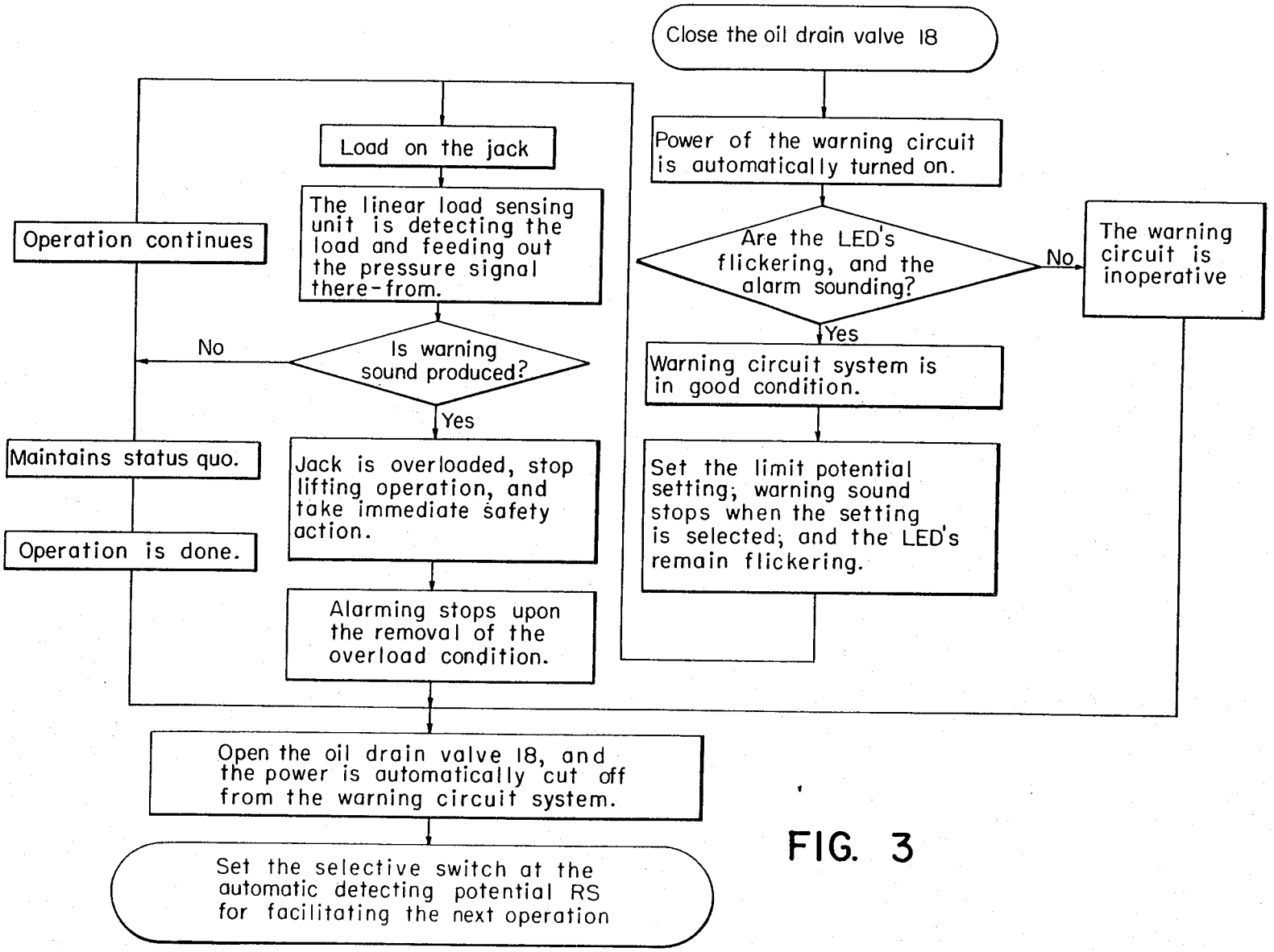
FIG. 3 is a working flow chart of the preferred embodiment of a separate overload detecting and warning system for hydraulic jacks according to this invention.

Referring to FIGS. 1, 2, and 3, operations of the preferred embodiment are as follows:

Before starting load-lift operation, the release valve 18 is turned to the closed position, which will cause the power switch $SW_1$ to be turned to the "ON" position through the connecting motion, and current will flow in the warning circuit system 30. At this time, the first multivibrator $OSC_1$ is energized to impress controlling signals to the indicating unit 32, causing $LED_1$ to start flickering thereat so as to indicate that the power source and $OSC_1$ circuit are in normal condition. Simultaneously, since the selective switch $SW_2$ is normally set at the automatic detecting potential from the load sensing unit 20 which will be equal to the no load potential, (i.e., the automatic warning detecting potential at RS), the limit setting and comparing circuit 34 will produce output control signals and feed them into $OSC_2$ for effecting a multiplied output to the alarm device 33 and produce the high-frequency howling thereat, which indicates the operative condition of the warning circuit. If no alarm sound is produced by the alarming device 33, it indicates that the warning circuit is inoperative. In this case, the user should open the release valve 18, which will automatically shut off the power swtich $SW_1$, and set aside the defective hydraulic jack 10 for safety reasons. If the warning circuit system is in the operative condition, the user sets the limit potential by turning the selective switch $SW_2$ to the desired position according to the actual requirement of the lifting operation.

In certain situations, consideration should be given to the no-load potential setting when, for example, an additional supporting element 50 (as shown in FIG. 1) is placed on top of the crown bar 14 of the hydraulic jack 10. As a result, the load capacity of the hydraulic jack 10 will be affected. For this reason, the safe load of the jack 10 has to be adjusted in conjunction with the extra supporting element 50.

According to the preferred embodiment of this invention, once the load limit potential is set in the warning circuit system 30 by adjusting the selective switch $SW_2$ to the required setting such as "1 ton", "2-ton", "3-ton", etc. (as shown in FIG. 2), the limit setting and comparing circuit 34 will cease to feed control signals to the multivibrator $OSC_2$, so that $OSC_2$ is prevented from multiplying the output signal fed from $OSC_1$, and the alarm device 33 immediately stops howling. In this condition, the overload warning circuit thereof is in the operative state, and the user can use the jack 10 with assurance.

By rocking the handle 40, a lifting operation will begin through the pumping device 15, the low-pressure cylinder 16 and the high-pressure cylinder 17. At this time, the linear load sensing unit 20 monitors the load condition of the jack 10 through the load sensing bypass pipe channel 12, which is always receiving the pressure signal from the high-pressure cylinder 17 (or the piping 11). As long as no alarm sound is produced by the alarm device 33 during the lifting operation, safety is ensured.

As shown in FIGS. 1 and 1A, when the jack 10 is operated to lift a load, a high-pressure signal from the load sensing by-pass pipe channel 12 will be fed to the linear load sensing unit 20 and actuates the piston mechanism 20, so that the piston crown rod 223 will in turn forcefully move the sector rack 260. The rack, in turn, drives the variable resistor 270 to make the same turn and results in the production of a linear feed-back signal therefrom. If the jack 10 is overloaded, the feed-back signal potential from the variable resistor 270 will be greater than or equal to the pre-selected limit potential of the limit setting and comparing circuit 34; therefore, a control signal from circuit 34 will be fed into the multivibrator $OSC_2$, together with the output signal from $OSC_1$. The signal is multiplied and applied to the alarm device 33 and produces the high-frequency howling thereat so as to warn the user than the jack 10 is overloaded. Immediate action should be taken either to stop using the jack 10 or to reduce the load thereof to ensure safe operation. After the lifting operation is over, the user simply turns the release valve 18 to the open position, which in turn automatically shuts off the power switch $SW_1$ through the connecting motion. The warning circuit system 30 immediately stops functioning, and at the same time, the hydraulic fluid returns through the opening of the release valve 18. The sector rack 260 and the variable resistor 270 also return to the original positions through the action of the reversing spring 280. In addition, for facilitating the next lifting operation, the user should set the selective switch $SW_2$ to the automatic detecting-potential position RS for performing the warning test the next time.

The preferred embodiment of this invention is simple in structure and convenient in operation; not only is the safe design perfected with multiple load-limit settings and self-detecting function, but also the structure is easy to install and economically manufactured.

While this invention has been illustrated and described by means of a preferred embodiment, it is to be understood that numerous changes and modifications may be made therein without departing from the spirit and scope of the invention as defined in the appended claims.

What is claimed is:

1. A separate overload detecting and warning system for hydraulic jacks generally having a high-pressure piping communicatively connected to a high-pressure cylinder, a pumping device matched with the high-pressure piping, a release valve connected between the high-pressure piping and a low-pressure cylinder, and a rocking bar mechanism movably connected to the pumping device for performing lifting operations, comprising:

a load sensing bypass pipe channel communicating with the high-pressure piping of the hydraulic jack for transferring the pressure signal therefrom;

a linear load sensing means directly connected to said load sensing bypass pipe channel for receiving the pressure signal thereof and converting it into an electric potential as an output;

a warning circuit means having multiple potential settings electrically coupled with said linear load sensing means for effecting warning functions in conjunction with the electric potential set thereat; and a power switching device electrically connected to said warning circuit means and mechanically connected with the release valve of the hydraulic jack for automatically turning the circuit means on and off with the closing and opening of the release valve so as to energize and de-energize said warning circuit means for performing circuit testing and overload warning functions therewith.

2. A separate overload detecting and warning system for hydraulic jacks according to claim 1 wherein said linear load sensing means comprises in combination:

an outer supporting frame;

a casing having a connecting head projecting from said outer supporting frame for communicating with said bypass pipe channel, an oil passage disposed in said connecting head in communication with a valve chamber formed in said casing;

a dynamic oil seal provided in said oil passage;

a piston mechanism disposed in said casing with the piston rod thereof movably joined to said valve chamber at one end;

a pressure spring coupled with said piston mechanism;

a covering plate secured to said casing to accommodate the other end of the piston rod in the middle portion;

a sector rack having a toothed portion pivotally fixed on said outer supporting frame with the sector stem movably engaged with the top of the piston rod; and a variable resistor having a toothed revolving shaft and a reverse spring matched therewith secured on said outer supporting frame with the toothed revolving shaft meshed with the toothed portion of said sector rack to effect resistor adjustment along with the movement of said piston mechanism through the pressure signal coming from said bypass pipe channel.

3. A separate overload detecting and warning system for hydraulic jacks according to claim 1 wherein said warning circuit means comprises in combination:

a DC power source associated with said power switching device;

an indicator circuit coupled with said DC power source for signaling the power circuit condition;

a first multivibrator electrically connected to said indicator circuit for controlling the indicating operations;

a second multivibrator electrically coupled with said first multivibrator for producing multiplied signals therefrom;

a limit potential setting and comparing circuit electrically connected to said power source and said second multivibrator for providing said second multivibrator with given limit potential and comparing signals thereof; and an alarming device electrically coupled with said second multivibrator and said power source for producing alarm sounds through signals supplied by said second multivibrator and performing warning functions thereby.

4. A separate overload detecting and warning system for hydraulic jacks according to claim 3 wherein said limit potential setting and comparing circuit further comprises:

a plurality of indicators electrically connected to said power source for indicating the normal condition of the circuit thereof;

a selective switching device having a plurality of potential settings electrically coupled with said power source and said second multivibrator for pre-selecting the limit potential in accordance with the requirement of load lifting operations; and a comparator electrically coupled with said selective switching device, said variable resistor and said second multivibrator for comparing the potential thereof and supplying control signals to said second multivibrator for effecting safety warning functions thereat.

5. A separate overload detecting and warning system for hydraulic jacks according to claim 4 wherein said selective switching device further comprises an automatic detecting potential setting arrangement, which, when energized, produces the potential value equal to that fed back by said linear load sensing means when no load is present on the hydraulic jack so as to effect the signaling of the warning circuit thereof in the operative condition.

6. A separate overload detecting and warning system for hydraulic jacks according to claim 4 wherein said indicators include a plurality of LED's respectively connected to the circuits of said potential settings and said variable resistor for signaling the operative condition of the individual circuit of said potential settings and said variable resistor during lifting operations.

* * * * *